US006237864B1

(12) United States Patent
Firdaus

(10) Patent No.: US 6,237,864 B1
(45) **Date of Patent: *May 29, 2001**

(54) CHIPPER SHREDDER CHUTE

(75) Inventor: Usman Firdaus, Strongsville, OH (US)

(73) Assignee: MTD Products Inc, Cleveland, OH (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 11 days.

(21) Appl. No.: 09/370,365

(22) Filed: Aug. 9, 1999

(51) Int. Cl.[7] ..... B02C 19/00
(52) U.S. Cl. ..... 241/92; 241/101.78
(58) Field of Search ..... 241/30, 92, 101.78, 241/282.1

(56) References Cited

U.S. PATENT DOCUMENTS

| | | | | |
|---|---|---|---|---|
| 3,817,462 | * | 6/1974 | Hamlin | 241/101.7 |
| 3,963,184 | | 6/1976 | Grimm | 241/101.1 |
| 4,076,460 | | 2/1978 | Roof | 417/236 |
| 4,169,561 | * | 10/1979 | Saxton | 241/101.1 |
| 4,283,018 | * | 8/1981 | Richard | 241/101.1 |
| 4,682,740 | | 7/1987 | Conigliaro et al. | 241/282.1 |
| 4,796,416 | | 1/1989 | Bendig et al. | 56/16.9 |
| 4,934,615 | | 6/1990 | Osborne | 241/101 A |
| 5,137,219 | | 8/1992 | Morey | 241/92 |
| 5,156,345 | * | 10/1992 | Baker | 241/56 |
| 5,199,654 | | 4/1993 | Fulghum, Sr. | 241/74 |
| 5,240,189 | | 8/1993 | Majkrzak et al. | 241/55 |
| 5,305,959 | | 4/1994 | Chesser | 241/100 |
| 5,323,939 | * | 6/1994 | Young | 222/463 |
| 5,340,035 | | 8/1994 | Ford | 241/55 |
| 5,381,970 | * | 1/1995 | Bold et al. | 241/55 |
| 5,408,815 | | 4/1995 | Forte | 56/17.5 |
| 5,603,459 | | 2/1997 | Gearing et al. | 241/56 |
| 5,667,152 | | 9/1997 | Mooring | 241/37.5 |
| 5,669,563 | * | 9/1997 | Gearing et al. | 241/101.78 |
| 5,707,017 | * | 1/1998 | Paolucci et al. | 241/55 |
| 5,836,528 | * | 11/1998 | Higarth | 241/93 |
| 5,860,606 | * | 1/1999 | Tiedeman et al. | 241/55 |

* cited by examiner

*Primary Examiner*—Allen Ostrager
*Assistant Examiner*—William Hong
(74) *Attorney, Agent, or Firm*—Emerson & Skeriotis; Roger D. Emerson; Timothy D. Bennett

(57) ABSTRACT

A shredder including a frame, a housing with a housing opening mounted to the frame, and a cutting blade mounted within the housing for use in shredding associated lawn debris is provided. The shredder also includes an engine mounted to the frame for use in driving the cutting blade and a hopper assembly for use in directing the associated lawn debris into the housing opening and to the cutting blade. The hopper assembly includes a chute having a first end pivotably connected to the housing and having a chute opening for receiving the associated lawn debris. The chute opening communicates with the housing opening. The chute can be positioned into first and second positions with respect to the housing. The hopper assembly also includes a flap for automatically covering at least a portion of the chute opening when the chute is placed in the first position and for automatically uncovering the opening when the chute is placed in the second position. A flap bail pivotably connected to the chute is used to hold the flap against an inner surface of the chute thereby uncovering the chute opening. The flap bail is adjusted as the chute is adjusted by an adjustment mechanism. The adjustment mechanism includes a control rod having a first end and a second end that is pivotably connected to the housing. The adjustment mechanism also includes an arm bracket having a first end fixedly connected to the first end of the flap bail and a second end pivotably connected to the first end of the control rod.

28 Claims, 7 Drawing Sheets

CHIPPER SHREDDER CHUTE

BACKGROUND OF THE INVENTION

I. Field of the Invention

This invention pertains to the art of methods and apparatuses for lawn care devices, and more particularly to methods and apparatuses for directing lawn debris within a chipper shredder apparatus.

II. Description of the Related Art

It is well known to provide chipper shredder apparatuses with a chute or hopper for use in directing lawn debris such as leaves and sticks into the cutting portion of the chipper shredder. A known problem that has remained unsolved in the art relates to the use of a positionable chute. Such a chute may be positioned in an upward facing position or, alternately, in a downwardly facing position. It is desirable to provide some type of guard that will prevent debris from being projected out of the chute while the chute is in the upward facing position. It is also desirable to provide a means for moving the guard out of the way while the chute is in the downwardly facing position. In this way, lawn debris can be easily swept into the chute without having to be forced through or around the guard.

U.S. Pat. No. 5,603,459 to Gearing et al. discloses a hopper fixedly attached to the main body of a chipper shredder machine. A multi-fingered guard is attached near one edge of the hopper and is used to prevent debris from being projected back out of the hopper. One disadvantage of this hopper is that it is fixed into an upwardly facing position. Debris close to the ground must be lifted to the height of the hopper before it can be inserted into the hopper. Another disadvantage is that the guard remains in the same relative position with regard to the hopper opening. In other words, the guard maintains a constant coverage over the cross-sectional area of the hopper opening.

In U.S. Pat. No. 5,340,035, Ford discloses a chipper shredder having two input chutes. One of the input chutes can be pivoted such that the chute opening faces in an upward direction or in a downward direction. A disadvantage is that no guard is provided with this chute. The other chute, fixed in an upwardly facing position, includes a manually adjustable cover that can be used to fully cover, or shut off, the opening of the chute. The disadvantage here, as in the shredder noted above, is that the chute cannot be adjusted into a downwardly facing direction and thus debris close to the ground must be lifted to the height of the hopper before it can be inserted into the chute.

Other similar designs are also known. In U.S. Pat. No. 4,796,416, Bendig et al. disclose a shredder that includes an input chute that has a dislodge press that is hinged to one side of the input chute. The chute of this patent is not position adjustable, and the dislodge press is only manually adjustable. In U.S. Pat. No. 5,667,152, Mooring discloses a chipper having a delivery chute with a gate that is automatically closed when a metal sensor senses metal entering the delivery chute. This invention requires the operator to wear gloves that have metal fragments. The delivery chute is not disclosed to be adjustable nor is the gate operable except in cooperation with the metal sensor. In U.S. Pat. No. 5,199,654, Fulghum Sr. discloses a feed chute used to feed a bark hog. Within the feed chute there is disclosed a material and air deflector rigidly mounted to the feed chute. There is no disclosure of the feed chute or deflector being adjustable in any way.

What is needed is a chute that includes a guard flap that covers at least a portion of the chute opening when the chute is positioned in an upwardly facing direction, but that automatically adjusts so that none of the chute opening is covered by the guard flap when the chute is positioned in a downwardly facing direction. The difficulties inherent in the art are therefore overcome in a way that is simple and efficient, while providing better and more advantageous overall results.

SUMMARY OF THE INVENTION

According to one aspect of this invention, a shredder includes a frame, a housing with a housing opening mounted to the frame, and a cutting blade mounted within the housing for use in shredding associated lawn debris. The shredder also includes an engine mounted to the frame for use in driving the cutting blade and a hopper assembly for use in directing the associated lawn debris into the housing opening and to the cutting blade. The hopper assembly includes a chute having a first end pivotably connected to the housing and having a chute opening for receiving the associated lawn debris. The chute opening communicates with the housing opening. The chute can be positioned into first and second positions with respect to the housing. The hopper assembly also includes covering means for automatically covering at least a portion of the chute opening when the chute is placed in the first position and for automatically uncovering the opening when the chute is placed in the second position.

According to another aspect of this invention, the chute has a first side with a first hole and a second side with a second hole. The covering means includes a flap having a first end operatively connected to a first inner surface of the chute and a flap bail having a generally U-shape. The flap bail has first and second ends forming first and second shaft portions that can be pivoted within the first and second holes in the chute, respectively. The covering means also includes an adjustment mechanism for use in selectively pivoting the flap bail from a first position to a second position. When in the second position, the flap bail holds a non-first end portion of the flap against the first inner surface of the chute.

According to another aspect of this invention, the adjustment mechanism includes a control rod having a first end and a second end that is pivotably connected to the housing. The adjustment mechanism also includes an arm bracket having a first end fixedly connected to the first end of the flap bail and a second end pivotably connected to the first end of the control rod.

According to still another aspect of this invention, the hopper assembly also includes securing means for securing the chute in the first position. Preferably, the chute includes at least a first groove and the securing means includes a release rod operatively connected to the housing. The release rod can be positioned into first and second positions. The release rod is received within the first groove in the chute when the chute is in the first position and the release rod is in the first position. The securing means may also include biasing means, such as springs, for biasing the release rod toward the first position.

One advantage of this invention is that when the chute is in the first, preferably upright position, the chute opening will be covered thereby preventing lawn debris from being thrown from the shredder assembly up through the chute opening.

Another advantage of this invention is that when the chute is in the second, preferably downward position, the chute opening will be uncovered thereby permitting lawn debris to be swept into the chute opening where it then easily proceeds to the shredder assembly.

Still another advantage of this invention is that the covering and uncovering of the chute opening occurs automatically as the chute is adjusted between its positions.

Still other benefits and advantages of the invention will become apparent to those skilled in the art upon a reading and understanding of the following detailed specification.

BRIEF DESCRIPTION OF THE DRAWINGS

The invention may take physical form in certain parts and arrangement of parts. A preferred embodiment of these parts will be described in detail in the specification and illustrated in the accompanying drawings, which form a part of this disclosure and wherein.

DESCRIPTION OF THE PREFERRED EMBODIMENT

Figure 1:
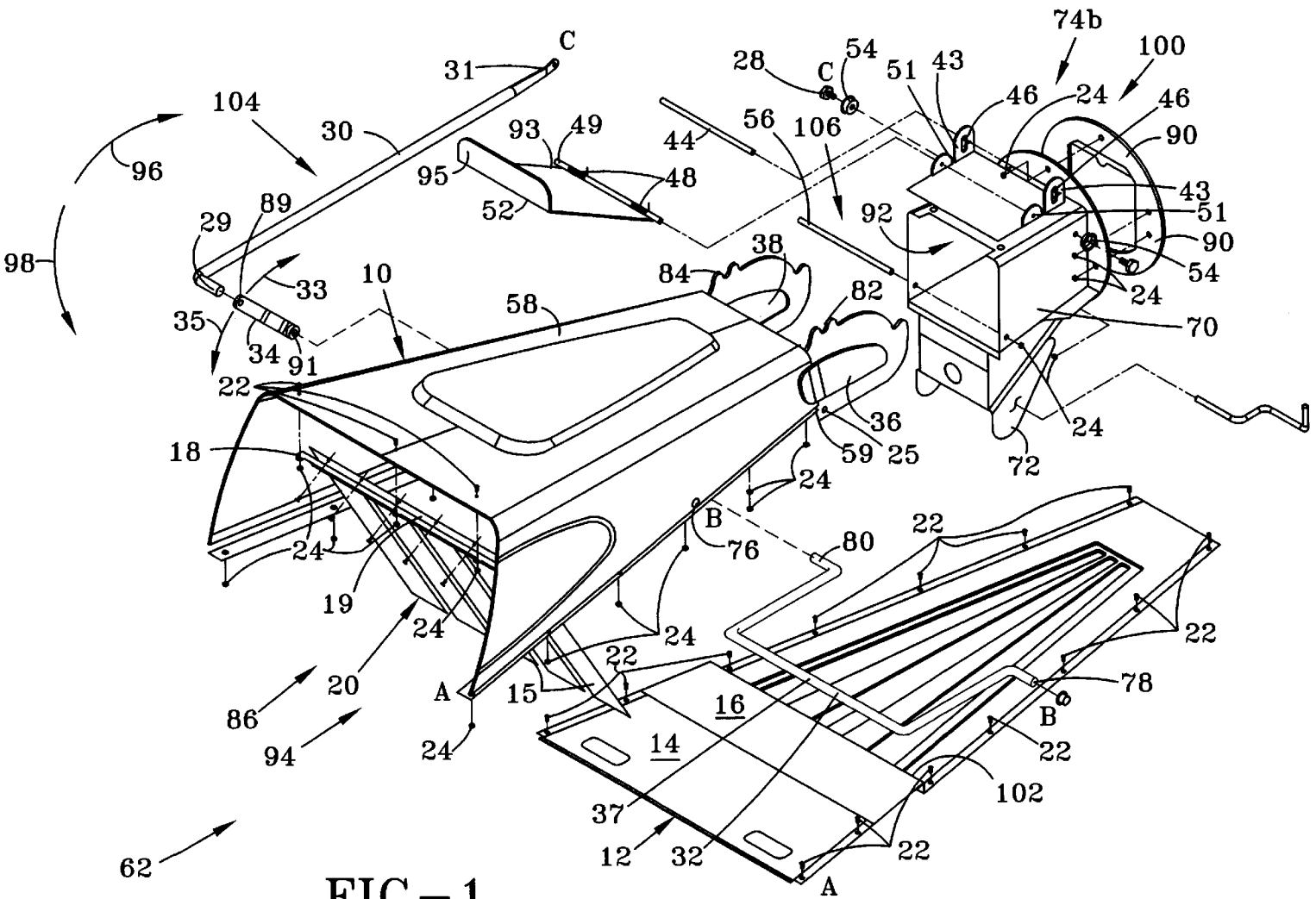
FIG. 1 is a perspective assembly drawing of the inventive hopper assembly.
Figure 3:
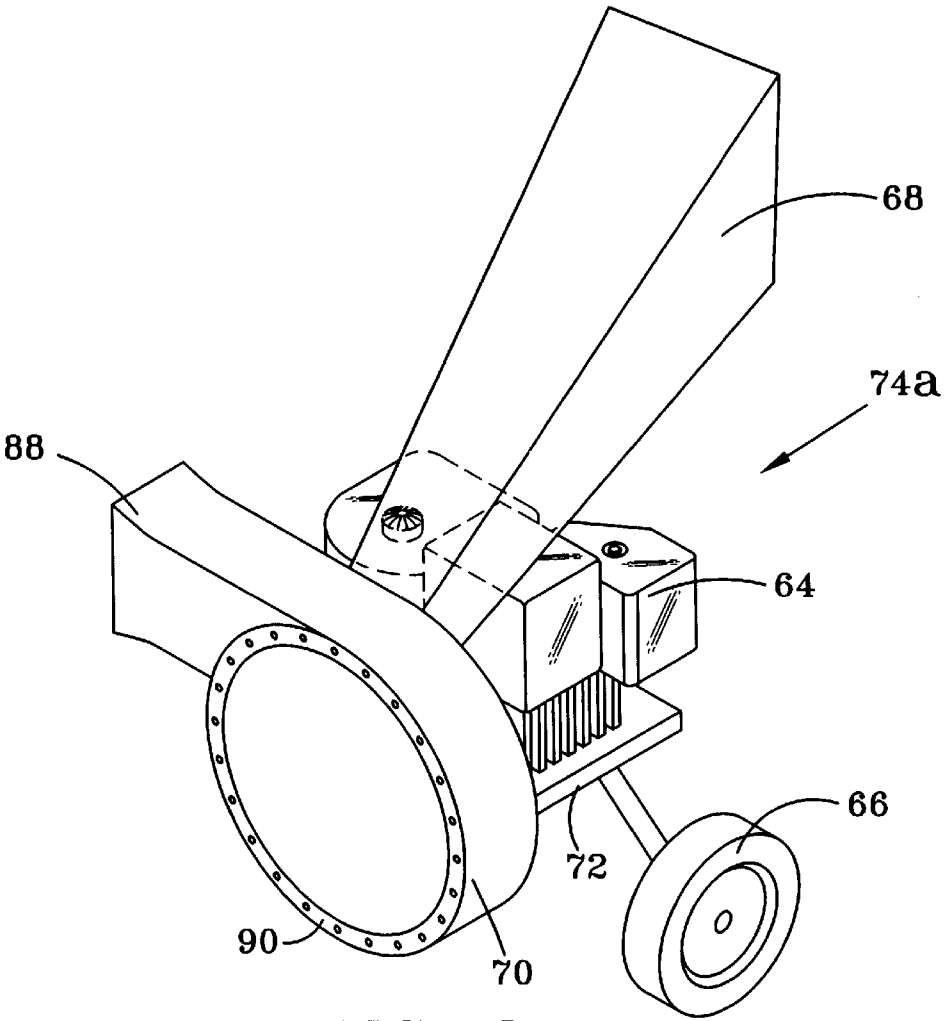
FIG. 3 is a perspective view of the back portion of the chipper/shredder apparatus.
Figure 7:
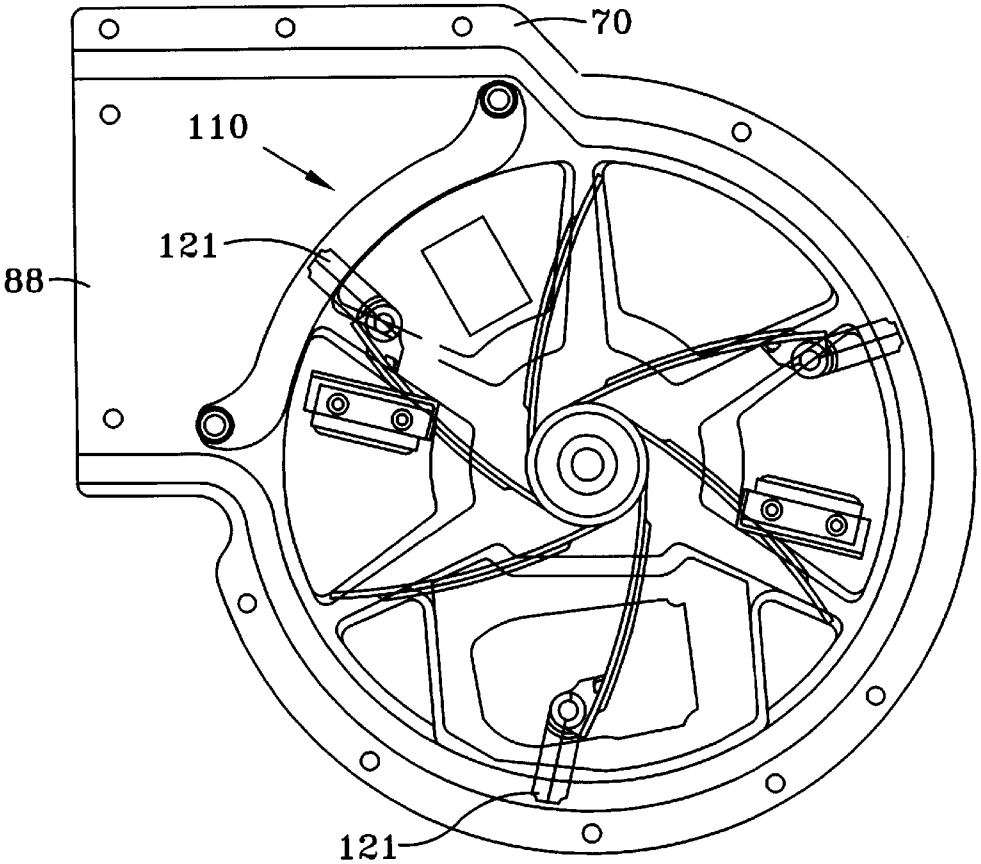
FIG. 7 is a sectional view through the housing showing the shredder assembly that is used to shred lawn debris.

Referring now to the drawings which are for purposes of illustrating a preferred embodiment of the invention only and not for purposes of limiting the same, FIG. 3 shows a back portion 74*a* of a chipper shredder apparatus 74 that when attached to a front portion 74*b*, shown in FIG. 1, may receive the inventive hopper assembly 62 also shown in FIG. 1. It should be understood that the front and back portions 74*b*, 74*a* combine to form a single shredder unit 74. The shredder 74 has a frame 72 that supports a shredder housing 70 and an engine 64. The portion of the housing 70 shown in FIG. 1 may connect to the portion shown in FIG. 3 by way of connection flanges 90 as shown. The housing 70 includes a housing opening 92 shown in FIG. 1 that permits lawn debris (not shown) to enter the housing 70. Within the housing 70, as shown in FIG. 7, is a rotatable shredder assembly 110 including cutting blades 121 that are used to shred the lawn debris as it enters the shredder assembly 110. Once the lawn debris has been shredded, it is discharged through outlet 88. A channel 68, shown in FIG. 3, for feeding sticks and the like may also communicate with the shredder assembly 110. Wheels 66 may also be attached to the frame 72 as may a handle (not shown) to enable the shredder 74 to be easily transported. It should be noted that the hopper assembly 62 of this invention can work just as well with any type of shredder and can work with any other apparatus chosen with sound engineering judgment.

With reference now to FIG. 1, the hopper assembly 62 is used to direct the lawn debris into the housing opening 92. The hopper assembly 62 includes a chute 58 having a chute opening 86 that communicates with the housing opening 92. The chute 58 has a first end 59 pivotably connected to the housing 70 permitting the chute 58 to be selectively positionable into first and second positions with respect to the housing 70. The specific positions of the chute 58 relative to the housing 70 that comprise the first and second positions can be any chosen with sound engineering judgment. In the preferred embodiment, however, the first position is when the chute 58 is pivoted in an upright or vertical position (that is, moved in first direction 96 as shown in FIG. 1) and the second position is when the chute 58 is pivoted in a downward or horizontal position (that is, moved in second direction 98 as shown in FIG. 1). The first position is ideal for use when sticks and twigs, for example, are being fed into the chute 58. The second position is ideal for use when leaves, for example, are being swept from the ground into the chute 58. The preferred embodiment also includes securing means 100 for securing the chute 58 into the first position. This is not a requirement for the invention. The chute 58 may be supported by the ground when in the second position.

With continuing reference to FIG. 1, the hopper assembly 62 also includes covering means 94 that automatically covers at least a portion of the chute opening 86 when the chute 58 is placed in the first position and that automatically uncovers the chute opening 86 when the chute 58 is placed in the second position. Thus, when the chute 58 is in the first (upright) position, the chute opening 86 will be covered thereby preventing lawn debris from being thrown from the shredder assembly 110 up through the chute opening 86. When the chute 58 is in the second (downward) position, the chute opening 86 will be uncovered thereby permitting lawn debris to be swept into the chute opening 86 where it then easily proceeds to the shredder assembly 110.

Still referring to FIG. 1, the particular design of the chute 58 can be of any type selected with appropriate wisdom. The preferred chute 58 has a generally rectangular shape in cross section and is formed of a first component 10 that is connected to a second component 12 by connecting means such as a series of hex screws 22 and lock nuts 24 as shown. The first component 10 provides three of the sides for the rectangular cross section and the second component 12 provides the fourth side and preferably forms the bottom portion of the chute 58. The second component 12 preferably includes an entry surface 14 that leads to a ramp surface 16 that is gradually sloped as shown. Both the entry surface 14 and the ramp surface 16 are used to guide lawn debris into the shredder 74. A lip 102 is formed between the ramp surface 16 and the remaining portion of the second component 12. The purpose for the lip 102 will be disclosed below. As noted above, the first end 59 of the chute 58 is pivotably connected to the housing 70. Preferably this pivoting connection is accomplished by providing holes 25 (only one visible in FIG. 1) in the chute 58 that receive a pivot rod 56 that is connected to the housing 70. Preferably, first and second extensions 36, 38 having first and second grooves 82, 84 extend from the first end 59 of the chute 58. The grooves 82, 84 (only one required) are used as will discussed further below. First and second holes 76, 77 (shown more clearly in FIG. 2) are used as will be discussed further below.

Figure 2:
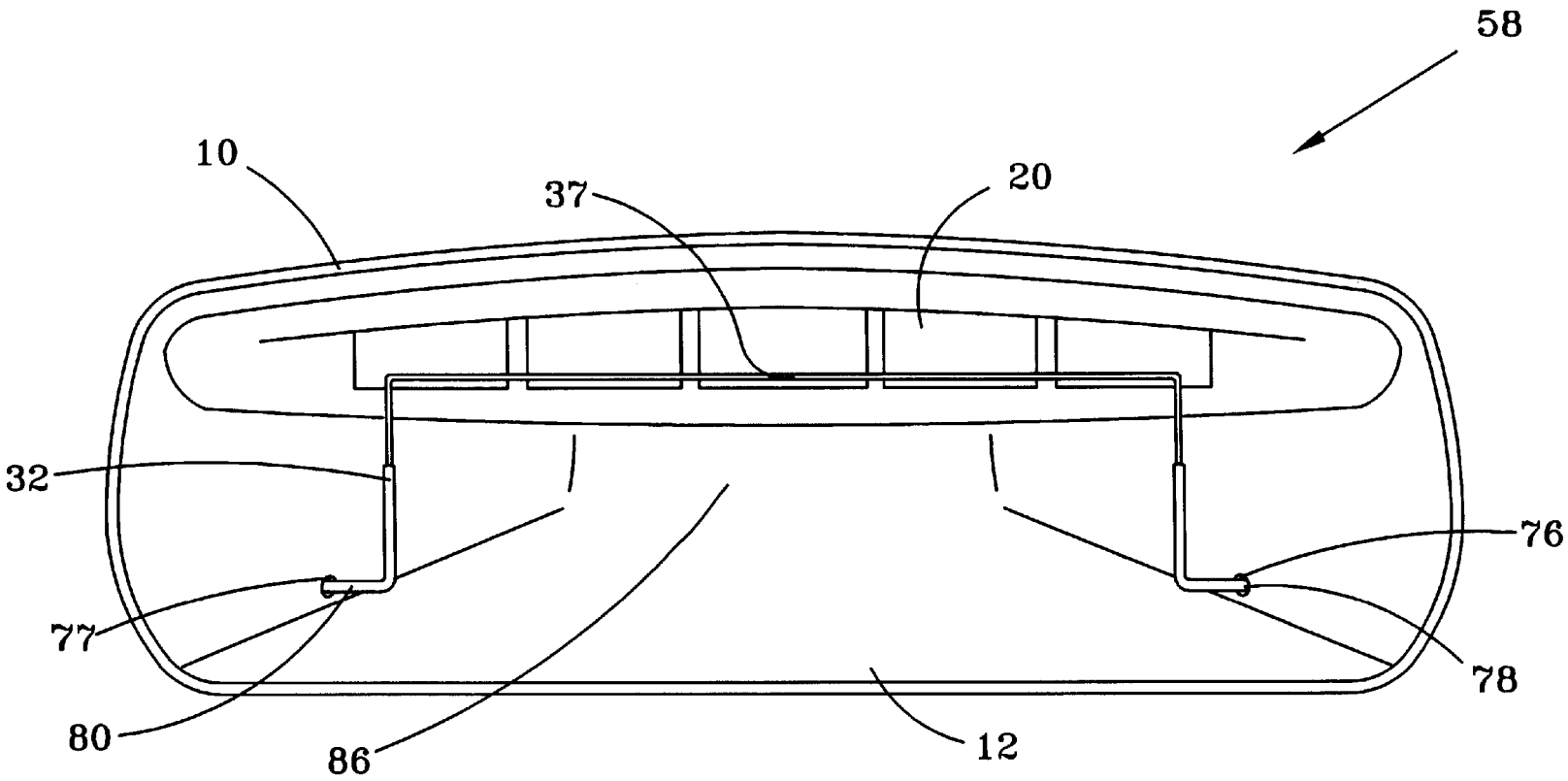
FIG. 2 is a sectional view of the hopper assembly illustrating the chute, the flap bail and the flap all in their second positions.

With reference now to FIGS. 1–2, the covering means 94 includes a flap 20, a flap bail 32 and an adjustment mechanism 104. The flap 20 is used to physically cover the chute opening 86 and has a first end 19 fixedly connected to an inner surface of the first component 10 using a flap mounting bracket 18 as shown. Preferably the flap 20 is made of a flexible material such as rubber or plastic and includes a plurality of finger sections 15. It is also preferred that the length of the flap 20 (from the first end 19 to the tips of the finger sections 15) is greater than the width of the chute opening 86. This provides sufficient flap material to fully cover the chute opening 86. The flap bail 32 is used to prevent the flap 20 from covering the chute opening 86. The flap bail 32 is generally U-shaped including first and second ends 78, 80 that form first and second shaft portions as shown. The flap bail 32 also has a mid-section 37 that selectively contacts the flap 20 as shown in FIG. 2. Thus, at substantially the same time, the flap 20 and flap bail 32 permit material to be received by the chute opening and prevent received material from exiting the chute opening. The shaft portions 78, 80 are received within the first and second holes 76, 77 respectively in the chute 58. Thus, the flap bail 32 is pivotable with respect to the chute 58. As shown in FIG. 1, the flap bail 32 can be positioned within the lip 102. In this way the flap bail 32 will not interfere with or block the supply of lawn debris to the housing opening 92.

With continuing reference to FIGS. 1–2, the adjustment mechanism 104 is used to selectively pivot the flap bail 32 between first and second positions. Preferably the position of the flap bail 32 corresponds with the position of the chute 58. Thus, when the chute 58 is in the first (upright) position, the flap bail 32 is in a first position lying against the inner surface of the second component 12 and within the lip 102. In this position the flap 20 is free to cover the chute opening 86. Similarly, when the chute 58 is in the second (downward) position (shown in FIG. 2), the flap bail 32 is in a second position holding the flap 20 against the inner surface of the first component 10. In this position the flap 20 is prevented from covering the chute opening 86. The adjustment mechanism 104 may be of any type chosen with sound engineering judgment but preferably includes a control rod 30 having first and second ends 29, 31 and an arm bracket 34 also having first and second ends 89, 91. The second end 31 of the control rod 30 is pivotably connected to the housing 70 preferably using a shoulder screw 28 that is fixedly attached to the control rod 30 and pivotaby received by a stop washer 54 that is itself attached to the housing 70. The first end 29 of the control rod 30 is pivotably connected to the second end 89 of the arm bracket 34. The first end 91 of the arm bracket 34 is fixedly connected to the first end 80 of the flap bail 32. The operation of the adjustment mechanism 104 will be discussed further below.

Figure 4:
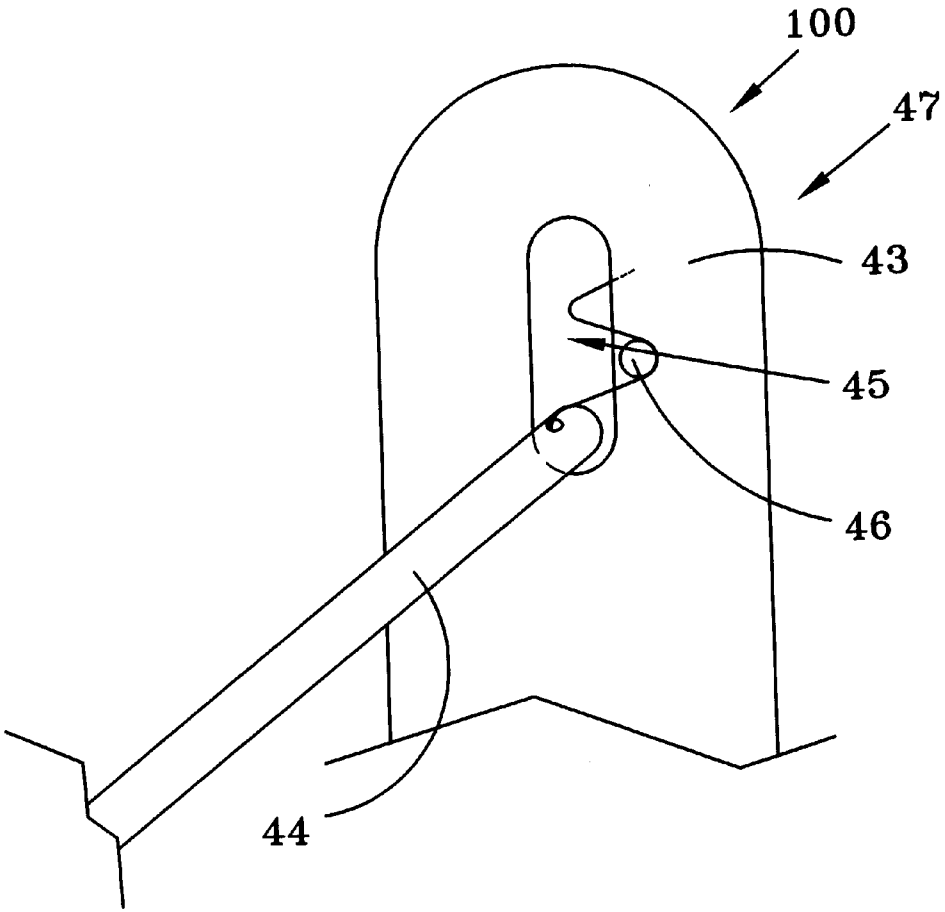
FIG. 4 is an exploded view illustrating the release rod in its first, secured position.
Figure 5:
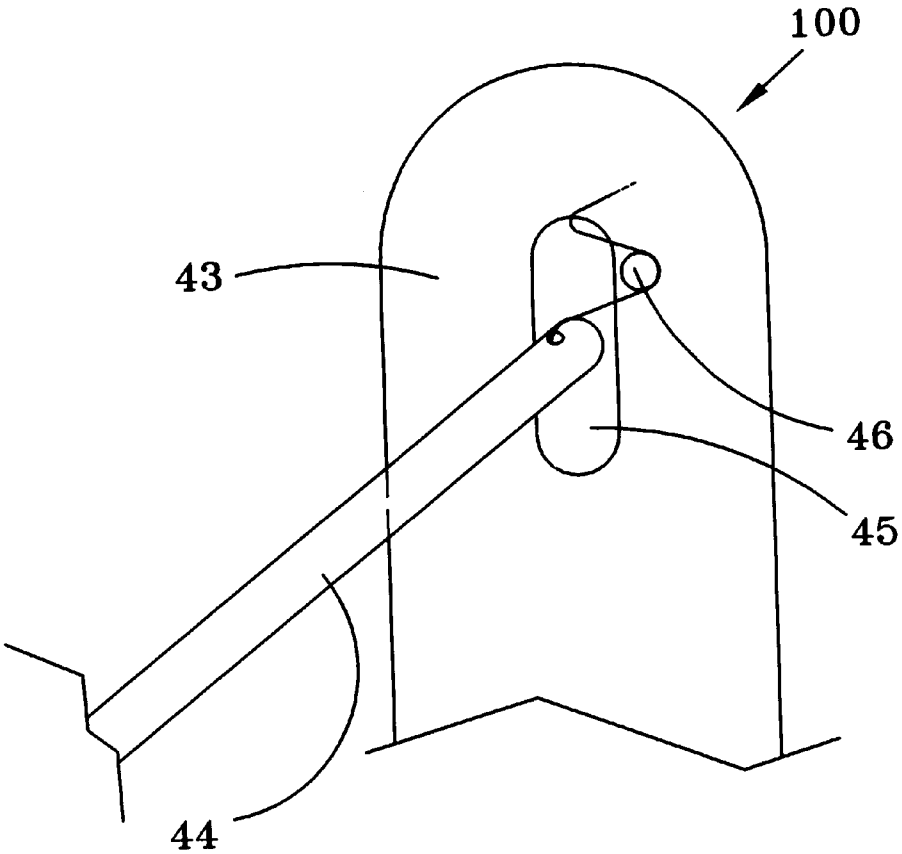
FIG. 5 is an exploded view similar to FIG. 4 but illustrating the release rod in its second, release position.
Figure 6:
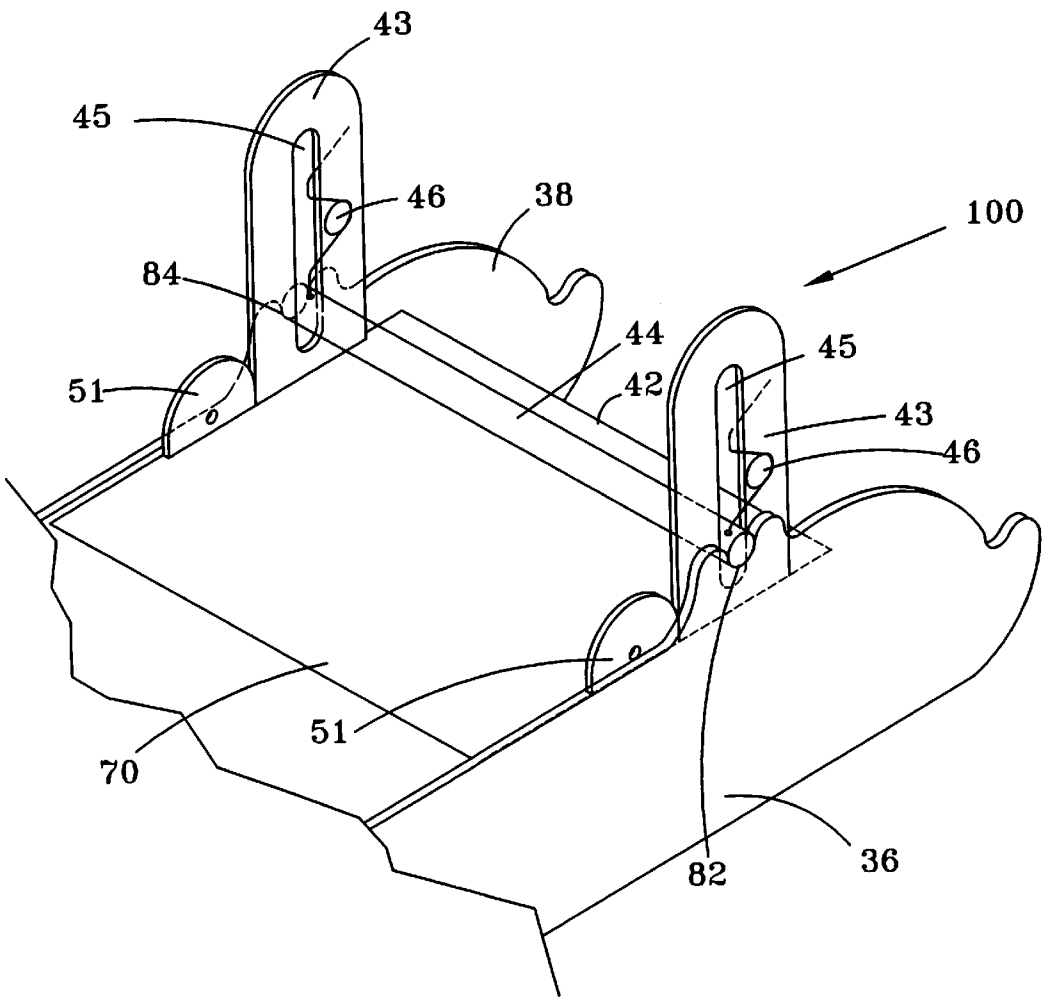
FIG. 6 is a perspective view illustrating the release rod received by the slots within the extensions.

With reference now to FIGS. 1 and 4–6, as noted above the securing means 100 is used to secure the chute 58 in the first position. The securing means 100 may be of any type that properly maintains the chute 58 in the first position. Preferably, the securing means 100 includes a release rod 44 operatively connected to the housing 70. As shown, the release rod 44 is received within first and second slots 45 that are preferably formed within extensions 43 of the housing 70. The release rod 44 can be selectively positioned into first and second positions. When the chute 58 is placed into its first (upright) position the release rod 44 is also placed into its first position which includes the release rod 44 being received within the first and second grooves 82, 84. The first position for the release rod 44 (shown in FIG. 4) can be thought of as a secured position because the chute 58 is secured to the housing 70 when the release rod 44 is in this position. The second position of the release rod 44 (shown in FIG. 5) can be thought of as a release position because the chute 58 is released to pivot about the housing 70 when the release rod 44 is in this position. The securing means 100 may also include biasing means 47 for use in biasing the release rod 44 into its first (locked) position. In this way, the chute 58 will not move out of its first position without adjustment by an operator. The biasing means 47 may be of any type chosen with sound engineering judgment but preferably includes at least one, most preferably two, torsion springs 46 at opposite ends of the release rod 44. The torsion springs 46 have one end received within the release rod 44 and a second end that wraps through the slot 45 and around the top of the extension 43 as shown in FIGS. 4–5. To adjust the release rod 44 from its first position to its second position it is only necessary for the operator to lift (upward as shown in FIGS. 1 and 4–6) the release rod 44 toward the tops of the slots 45. This movement overcomes the biasing force of the torsion springs 46.

Referring again to FIG. 1, it should be noted that when the chute 58 is in its second (downward) position a chute void 106 is formed between the first end 59 of the chute 58 and the top portion of the housing 70. No such void is formed on the sides as the first and second extensions 36, 38 provide cover. The chute void 106 is undesirable as it reduces the suction available at the chute opening 86 when the shredder assembly 110 is operated. To cover the chute void 106, a door 52 having first and second ends 93, 95 is provided. The first end 93 is pivotably connected to the housing 70 preferably using a door rod 49 that is received within holes in a pair of door flanges 51 (shown also in FIG. 6). The second end 95 of the door 52 is preferably received within the chute 58 such that the second end 95 contacts the inner surface of the first component 10. In this way, when the chute 58 is adjusted between its positions, the door 52 remains within the chute 58. It is also preferred that biasing means such as door springs 48 be used to bias the door against the chute 58. In this way the chute void 106 is continually covered. The door springs 48 may receive the door rod 49 as shown.

With reference now to FIGS. 1–7, the operation of the hopper assembly 62 will now be described. To adjust the position of the chute 58 form the first position to the second position the securing means 100, if used, must be disengaged. To accomplish this, the operator simply lifts (upward as shown in FIGS. 1 and 4–6) the release rod 44 toward the tops of the slots 45 thereby overcoming the biasing force of the torsion springs 46. In other words, the operator moves the release rod 44 from its first (secured) position to its second (release) position. This movement of the release rod 44 moves the release rod 44 out of engagement with the first and second grooves 82, 84 of the chute 58, freeing the chute 58 to be pivoted about the pivot rod 56. The operator then lets go of the release rod 44 and simply lowers the chute 58 in direction 98 till the chute 58 rests against the ground—this is the second position.

With continuing reference to FIGS. 1–7, during the movement of the chute 58 between its first and second positions, the flap bail 32 is moved from its first position (positioned within the lip 102) to its second position (holding the flap 20 against the inner surface of the chute 58 as shown in FIG. 2). Thus, the movement of the flap bail 32 moves the flap 20 from a first position that covers at least a portion of the chute opening 86 to a second position (FIG. 2) that uncovers the chute opening 86. The movement of the chute 58 causes the movement of the flap bail 32. As the chute 58 is being lowered (direction 98), the control rod 30 is pivoting about the housing 70 also in direction 98. This causes the arm bracket 34 to pivot about its first end 91 in clockwise direction 33. As the arm bracket 34 pivots it causes the flap bail 32 to also pivot about its first and second shaft portions 78, 80 within the chute opening 86. In this way the mid-section 37 of the flap bail 32 holds the flap 20 against the inner surface of the chute 58 as shown in FIG. 2. This permits lawn debris to be swept into the chute 58 without encountering any interference from the flap 20.

Referring to FIG. 1, as noted above the movement of the chute 58 from its first position to its second position may cause the chute void 106 to be formed. However, the movement of the chute 58 also permits the door 52 to pivot about door rod 49 due to the biasing force of the door springs 48. In this way the chute void 106 remains continually covered or sealed.

With reference again to FIGS. 1–7, to adjust the position of the chute 58 form the second position to the first position, the operator simply lifts the chute 58 in direction 96. If the preferred securing means 100 is used, once the chute 58 is in the first (full upright) position the first and second extensions 36, 38 of the chute 58 contact the release rod 44 such that the release rod 44 is received within the first and second grooves 82, 84. When this occurs the torsion springs 46 force the release rod 44 within the grooves 82, 84 and hold the release rod 44 secure therein.

Still referring to FIGS. 1–7, during the movement of the chute 58 between its second and first positions, the flap bail 32 is moved from its second position (holding the flap 20 against the inner surface of the chute 58) to its first position (positioned within the lip 102). Thus, the movement of the flap bail 32 moves the flap 20 from the second position that uncovers the chute opening 86 to the first position that covers at least a portion of the chute opening 86. As the chute 58 is being raised (direction 96), the control rod 30 is pivoting about the housing 70 also in direction 96. This causes the arm bracket 34 to pivot about its first end 91 in counter-clockwise direction 35. As the arm bracket 34 pivots it causes the flap bail 32 to also pivot about its first and second shaft portions 78, 80 within the chute opening 86. In this way the mid-section 37 of the flap bail 32 releases the flap 20 to cover the chute opening 86. This permits lawn debris to be feed into the chute 58 at will while preventing lawn debris from being thrown out of the shredder assembly 110 and up through the chute opening 86.

The invention has been described with reference to the preferred embodiment. Obviously, modifications and alterations will occur to others upon a reading and understanding of the specification. It is intended by applicant to include all such modifications and alterations insofar as they come within the scope of the appended claims or the equivalents thereof.

What is claimed is:

1. A shredder comprising:

a frame;

a housing mounted to the frame, the housing including a housing opening;

a cutting blade mounted within the housing for use in shredding associated lawn debris;

an engine mounted to the frame for use in driving the cutting blade; and, a hopper assembly for use in directing the associated lawn debris into the housing opening and to the cutting blade, the hopper assembly including, 1) a chute having a first end pivotably connected to the housing and having a chute opening for receiving the associated lawn debris, the chute opening communicating with the housing opening, the chute being selectively positionable into first and second positions with respect to the housing; and, 2) covering means for automatically covering at least a portion of the chute opening when the chute is placed in the first position and for automatically uncovering the opening when the chute is placed in the second position.

2. The shredder of claim 1 wherein said chute has a first side with a first hole and a second side with a second hole, said covering means comprising:

a flap having a first end operatively connected to a first inner surface of said chute;

a flap bail having a generally U-shape and having first and second ends forming first and second shaft portions that are selectively pivotable within said first and second holes in said chute respectively; and, an adjustment mechanism for use in selectively pivoting said flap bail from a first position to a second position against said flap such that a non-first end portion of said flap is held against said first inner surface of said chute.

3. The shredder of claim 2 wherein said chute comprises a lip formed in second inner surface of said chute, at least a portion of said flap bail fitting within aid lip when said flap bail is in said first position.

4. The shredder of claim 2 wherein said adjustment mechanism comprises:

a control rod having a first end and a second end that is pivotably connected to said housing; and, an arm bracket having a first end fixedly connected to said first end of said flap bail and a second end pivotably connected to said first end of said control rod.

5. The shredder of claim 4 wherein a chute void is formed between said chute and said housing when said chute is in said second position, said chute comprising first and second extensions operatively connected to said first and second sides of said chute respectively, said first extension having a first groove and said second extension having a second groove, said shredder further comprising, a door having first and second ends for covering said chute void, said first end of said door being pivotably connected to said housing;

biasing means for biasing said second end of said door against said chute; and, securing means for securing said chute in said first position, said securing means including, 1) a release rod operatively connected to said housing and being selectively positionable into first and second positions, said release rod having a first end received within said first groove and a second end received within said second groove when said chute is in said first position and said release rod is in said first position; and, 2) biasing means for biasing said release rod toward said first position.

6. The shredder of claim 1 wherein said hopper assembly further comprises: securing means for securing said chute in said first position.

7. The shredder of claim 6 wherein said chute includes at least a first groove, said securing means comprising:

a release rod operatively connected to said housing and being selectively positionable into first and second positions, said release rod being received within said first groove in said chute when said chute is in said first position and said release rod is in said first position; and, biasing means for biasing said release rod toward said first position.

8. The shredder of claim 1 wherein a chute void is formed between said chute and said housing when said chute is in said second position, said shredder further comprising:

a door having first and second ends for covering said chute void, said first end of said door being pivotably connected to said housing; and, biasing means for biasing said second end of said door against said chute.

9. A hopper assembly for use with an apparatus, the hopper assembly comprising:

a chute operatively connected to the apparatus having a chute opening for receiving associated material, the chute being selectively positionable into first and second positions with respect to the apparatus, the chute being in a substantially upright position when in the first position and in a substantially horizontal position when in the second position; and, covering means for automatically covering at least a portion of the chute opening when the chute is placed in the first position and for automatically uncovering the chute opening when the chute is placed in the second position.

10. The hopper assembly of claim 9 wherein said chute has a first side with a first hole and a second side with a second hole, said covering means comprising:

a flap having a first end operatively connected to a first inner surface of said chute;

a flap bail having a generally U-shape and having first and second ends forming first and second shaft portions that are selectively pivotable within said first and second holes in said chute respectively; and, an adjustment mechanism for use in selectively pivoting said flap bail from a first position to a second position against said flap such that a non-first end portion of said flap is held against said first inner surface of said chute, wherein when the flap covers at least the portion of the chute opening, the flap and flap bail permit associated material to be received by the chute opening and substantially simultaneously prevent associated material from exiting the chute opening.

11. The hopper assembly of claim 10 wherein said adjustment mechanism comprises:

a control rod having a first end and a second end that is pivotably connected to said apparatus; and, an arm bracket having a first end fixedly connected to said first end of said flap bail and a second end pivotably connected to said first end of said control rod.

12. The hopper assembly of claim 11 wherein said apparatus includes at least a first groove, the hopper assembly further comprising:

securing means for securing said chute in said first position, said securing means including, 1) a release rod operatively connected to said apparatus and being selectively positionable into first and second positions, said release rod being received within said first groove in said chute when said chute is in said first position and said release rod is in said first position; and, 2) biasing means for biasing said release rod toward said first position.

13. A method of adjusting the position of a chute, the method comprising the steps of:

providing a shredder having a frame, a housing with a housing opening mounted to the frame, a cutting blade mounted within the housing for use in shredding associated lawn debris, and an engine mounted to the frame for use in driving the cutting blade;

providing a chute having a first end pivotably connected to the housing and a chute opening for receiving associated lawn debris such that the chute opening communicates with the housing opening;

pivoting the chute from a first position relative to the housing toward a second position thereby moving a flap from a first position that covers at least a portion of the chute opening to a second position that uncovers the chute opening, the first position relative to the housing being a substantially vertical position and the second position being a substantially horizontal position.

14. The method of claim 13 wherein, the step of pivoting the chute from a first position relative to the housing toward a second position thereby moving a flap from a first position that covers at least a portion of the chute opening to a second position that uncovers the chute opening, the first position relative to the housing being a substantially vertical position and the second position being a substantially horizontal position, comprises the steps of:

pivoting a flap bail within the chute opening; and, holding the flap against an inner surface of the chute, the flap bail permitting associated material to be received by the chute opening and substantially simultaneously preventing associated material from exiting the chute through the chute opening.

15. The method of claim 14 wherein, the step of pivoting the chute from a first position relative to the housing toward a second position thereby moving a flap from a first position that covers at least a portion of the chute opening to a second position that uncovers the chute opening, the first position relative to the housing being a substantially vertical position and the second position being a substantially horizontal position, further comprises the steps of:

pivoting a flap control rod about the housing; and, pivoting an arm bracket thereby pivoting the flap bail.

16. The method of claim 14 further comprising the step of:

pivoting the chute from the second position relative to the housing toward the first position thereby moving the flap from the second position that uncovers the chute opening to the first position that covers at least a portion of the chute opening.

17. The method of claim 16 wherein, the step of pivoting the chute from the second position relative to the housing toward the first position thereby moving the flap from the second position that uncovers the chute opening to the first position that covers at least a portion of the chute opening, comprises the steps of:

pivoting the flap bail within the chute opening;

releasing the flap from the inner surface of the chute; and, securing the chute in the first position.

18. The method of claim 13 wherein, the step of pivoting the chute from a first position relative to the housing toward a second position thereby moving a flap from a first position that covers at least a portion of the chute opening to a second position that uncovers the chute opening, the first position relative to the housing being a substantially vertical position and the second position being a substantially horizontal position, comprises the steps of:

forming a chute void between the chute and the housing; and, sealing the chute void.

19. The method of claim 13 wherein, before the step of pivoting the chute from a first position relative to the housing toward a second position thereby moving a flap from a first position that covers at least a portion of the chute opening to a second position that uncovers the chute opening, the first position relative to the housing being a substantially vertical position and the second position being a substantially horizontal position, the method comprises the step of:

disengaging securing means that secures the chute in the first position.

20. The method of claim 19 wherein, the step of disengaging securing means that secures the chute in the first position, comprises the steps of:

providing a first groove in the chute that selectively operatively receives a release rod operatively connected to the housing; and, moving the release rod out of engagement with the first groove in the chute.

21. A shredder comprising:

a frame;

a housing mounted to the frame, the housing including a housing opening;

a cutting blade mounted within the housing for use in shredding associated lawn debris;

an engine mounted to the frame for use in driving the cutting blade; and, a hopper assembly for use in directing the associated lawn debris into the housing opening and to the cutting blade, the hopper assembly including, 1) a chute having a first end pivotably connected to the housing and having a chute opening for receiving the associated lawn debris, the chute opening communicating with the housing opening, the chute being selectively positionable into first and second positions with respect to the housing, said first position being a substantially upright position and the second position being a substantially horizontal position; and, 2) a flap for automatically covering at least a portion of the chute opening when the chute is placed in the first position and for automatically uncovering the opening when the chute is placed in the second position.

22. The shredder of claim 21, wherein the chute contacts an underlying surface when in the second position.

23. The shredder of claim 21, wherein said flap is flexible.

24. The shredder of claim 23, wherein said flexible flap is plastic.

25. The shredder of claim 23, wherein said flexible flap is plastic.

26. The shredder of claim 21, wherein said flap further comprises a plurality of finger sections.

27. The shredder of claim 21, wherein the chute has a first side with a first hole and a second side with a second hole, said flap having a first end operatively connected to a first inner surface of said chute, said flap further comprising:

a flap bail having a generally U-shape and having first and second ends forming first and second shaft portions that are selectively pivotable within said first and second holes in said chute respectively; and, an adjustment mechanism for use in selectively pivoting said flap bail from a first position to a second position against said flap such that a non-first end portion of said flap is held against said first inner surface of said chute.

28. The shredder of claim 27, wherein the flap prevents the received associated debris from exiting the chute opening and substantially simultaneously, the flap and flap bail permit additional associated debris to pass through the chute opening.

* * * * *